United States Patent [19]

Pate

[11] Patent Number: 4,490,863

[45] Date of Patent: Jan. 1, 1985

[54] PORTABLE HAND-HELD URINE DISPOSAL SYSTEM FOR RESIDENTIAL STRUCTURES

[76] Inventor: Grover C. Pate, P.O. Box 907, Forest Hills Subdivision, Lillington, N.C. 27546

[21] Appl. No.: 432,793

[22] Filed: Jan. 3, 1983

Related U.S. Application Data

[63] Continuation-in-part of Ser. No. 327,428, Dec. 4, 1981, abandoned.

[51] Int. Cl.[3] ..... E03D 13/00

[52] U.S. Cl. ..... 4/301; 4/144.1; 4/340; 4/461; 4/664

[58] Field of Search ..... 4/144.1, 144.2, 144.3, 4/301, 340, 341, 662–664, 303, 304, 305, 458, 114.1, 460, 461, 462, 463

[56] References Cited

U.S. PATENT DOCUMENTS

| | | | |
|---|---|---|---|
| 456,073 | 7/1891 | White | 4/303 |
| 2,395,150 | 2/1946 | Sloan et al. | 4/303 |
| 2,786,210 | 3/1957 | Fraser | 4/303 |
| 3,066,314 | 12/1962 | Filliung | 4/303 |
| 3,500,480 | 3/1970 | Michal, Jr. | 4/144.4 |
| 3,703,731 | 11/1972 | Leiser | 4/144.3 |
| 3,822,419 | 7/1974 | Wilson, Jr. | 4/144.4 |
| 3,964,110 | 6/1976 | Kapit | 4/301 |
| 4,050,103 | 9/1977 | Nakao et al. | 4/144.3 X |
| 4,121,306 | 10/1978 | Bringman et al. | 4/144.2 |
| 4,134,163 | 3/1979 | Matsunga | 4/302 |
| 4,137,579 | 2/1979 | Soler | 4/144.3 X |
| 4,145,768 | 3/1979 | Chavrette | 4/144.1 |
| 4,202,058 | 5/1980 | Anderson | 4/144.3 |
| 4,282,611 | 8/1981 | O'Day | 4/301 |
| 4,345,341 | 8/1982 | Saito | 4/301 |
| 4,345,342 | 8/1982 | Saito | 4/305 |

*Primary Examiner*—Henry K. Artis
*Attorney, Agent, or Firm*—Mills & Coats

[57] ABSTRACT

The present invention entails a hand-held urine receiver that is constructed in the general form of a reservoir and is communicatively connected to a flexible hose. The flexible hose extends from the urine receiver and is communicatively connected to a drain line that forms a part of the plumbing network of a residential structure. In order to adapt the urine receiver of the present invention for female use, there is provided a vaginal insert.

1 Claim, 5 Drawing Figures

PORTABLE HAND-HELD URINE DISPOSAL SYSTEM FOR RESIDENTIAL STRUCTURES

REFERENCE TO RELATED APPLICATION

This is a continuation-in-part of U.S. patent application Ser. No. 327,428, filed Dec. 4, 1981 and now abandoned.

FIELD OF INVENTION

The present invention relates to urinal and toilet devices, and more particularly to a portable hand-held dry urinal disposal system that is communicatively connected with a drain line forming a part of the plumbing network of a residential structure.

BACKGROUND OF INVENTION

As an alternate to conventional wet or flush toilet systems and for the purpose of saving water, there have been attempts at designing portable dry urinal devices. For example, one is referred to the disclosures found in the following U.S. Pat. Nos. 3,964,110; 2,375,090; and 2,374,725. Generally the systems have been relatively complex, expensive and even sometimes impractical. This is especially true in the sense that some such systems the complexity and expense thereof have more than off-set any advantage realized by not requiring the use of water to flush.

In addition, very few of such systems have been completely portable in nature. By this it is meant that the urine receiver cannot be held by hand and moved to a convenient location for accepting urine. In this same regard, often such urine receivers are not really adapted to be efficiently used by a female, and consequently are not optimumly used.

There has been and continues to be a need for a portable, nonflushable, urinal that is relatively simple, inexpensive and which is easily adapted to be communicatively connected to a drain line forming a part of the plumbing network of a residential structure.

SUMMARY AND OBJECTS OF INVENTION

The present invention presents a portable hand-held urine device, of the nonflushing type, that is particularly designed to be utilized in conjunction with a drain line forming a part of the plumbing network of a conventional residential structure. In addition the portable dry urinal device of the present invention includes an elongated urine receiver that has an open top for generally receiving urine therein from a male during the urination process. In addition, there is provided a vaginal insert adapted to be inserted into or onto said urine receiver for enabling a female to effectively and efficiently utilize the same.

It is, therefore, an object of the present invention to provide a portable dry hand-held urinal device that is adapted to work in conjunction with a drain line forming a part of the plumbing network of a residential structure and which does not require constant flushing as do conventional wet toilet systems.

Another object of the present invention resides in the provision of a portable dry, hand-held urine disposal device that is simple, relatively inexpensive, and which is easy to use and particularly designed in order that the same can be effectively and efficiently used by both males and females.

Still a further object of the present invention resides in the provision of a portable dry hand-held urinal device of the character referred to above that is provided with a special vaginal insert that enables the same to be conveniently and effectively used by females.

It is also an object of the present invention to provide a portable dry hand-held urinal device that is essentially provided with a urine receptacle, a flexible hose communicatively connected to the urine receiver or receptacle and means for communicatively connecting the flexible hose to a drain line, such as a sink drain, a main drain or septic tank line extending exteriorly of a residential structure for receiving and channeling urine therefrom.

It is also an object of the present invention to provide a unique and novel urine disposal system for a public restroom facility wherein a plurality of removable lightweight urinals are operatively connected to a drain line that is also connected to one or more lavatories.

A further object of the present invention is to provide a relatively inexpensive urine disposal system that utilizes a plurality of lightweight urinals operatively connected to an existing drain line that serves to channel waste water from one or more lavatories.

It is also an object of the present invention to provide a urine disposal system of the character referred to above wherein the respective urinals can be easily and conveniently removed from said drain line for cleaning.

Other objects and advantages of the present invention will become apparent from a study of the following description and the accompanying drawings which are merely illustrative of the present invention.

DESCRIPTION OF PREFERRED EMBODIMENT

Figure 1:
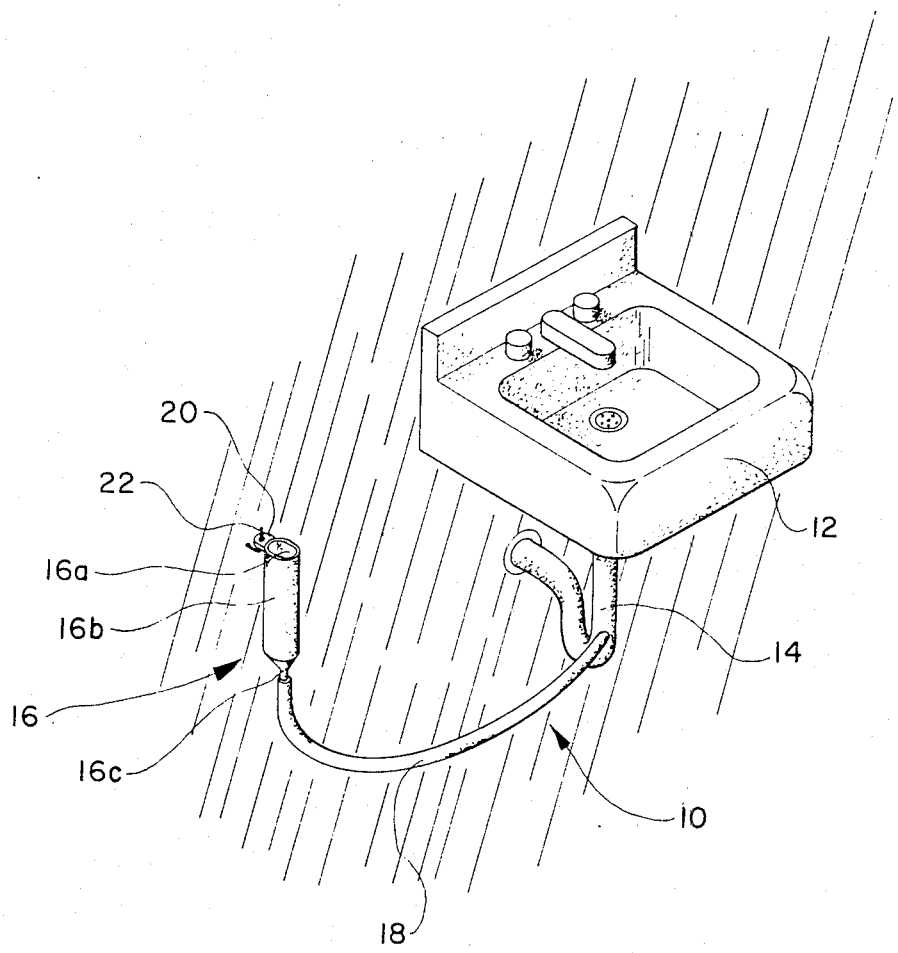
FIG. 1 is a perspective view of the portable dry hand-held urine disposal device of the present invention communicatively connected to the drain line of a conventional lavatory sink.

With further reference to the drawings, and particularly FIG. 1, the portable dry hand-held urinal disposal device of the present invention is shown therein and indicated generally by the numeral 10. In the species or design shown in FIG. 1, the same is particularly adapted to be utilized within a bathroom or the like within a residential structure and is particularly designed to be communicatively connected to a sink line 14 that extends underneath a lavatory type sink 12.

Viewing the portable urinal disposal system of the present invention, it is seen that the same includes a urine receiver 16. In the case of this preferred design, urine receiver 16 is generally elongated and includes an open top 16*a*, a surrounding wall structure 16*b*, and a tapered bottom 16*c* that includes an opening therein from which received urine may exit.

Urine receiver 16 can be molded from plastic or made from any other suitable material. Its principal function is to serve as a receiver for the urine being emitted from an individual during the urination process.

Although the size and shape of urine receivers 16 may vary depending on particular applications, it is seen that the same is generally oval shaped and includes an arcuately shaped surrounding wall structure 16*b*.

To support the same in an elevated position, preferably adjacent a wall, there is provided a supporting clip 20 that extends from the top portion of the urine receiver 16 and includes an opening therein for receiving a supporting hook 22 that would preferably extend from a wall or other upright support structure.

Figure 2:
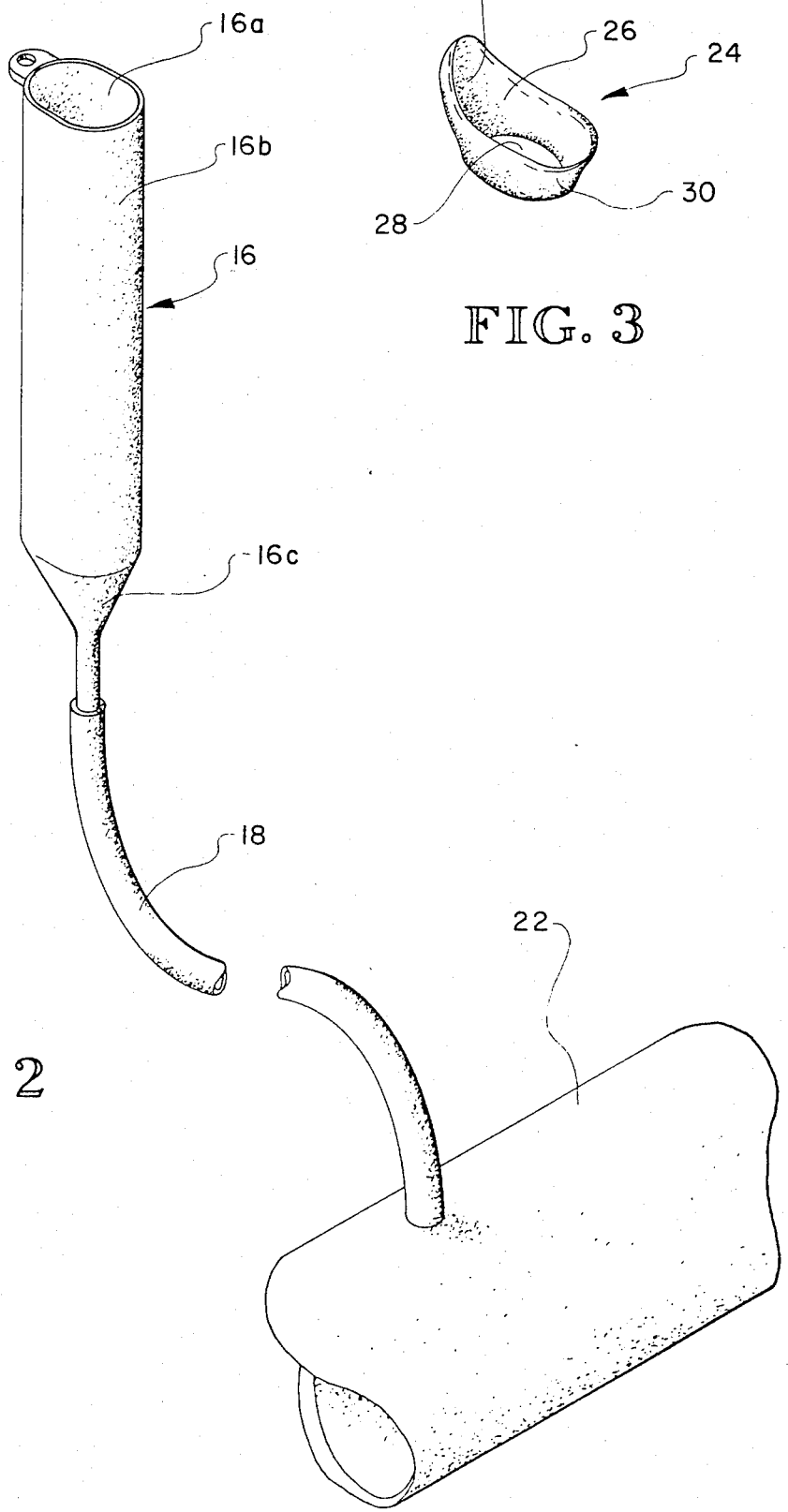
FIG. 2 is an enlarged perspective view of the urine receiver of the urine disposal system of the present invention generally illustrating the same communicatively connected to a main drain or septic tank line extending generally exteriorly of the residential structure.

Turning to FIG. 2, therein it is disclosed and illustrated a second application of the portable dry urine disposal system of the present invention. Herein it is illustrated that the system, as described hereinabove and particularly with respect to FIG. 1, in the form of the urine receiver 16 and flexible hose 18 is communicatively connected to a main drain or sewer line 22 that would extend exteriorly of the residential structure. Consequently, it is appreciated that the flexible hose 18 could be connected to various drain or septic lines forming a part of the plumbing of a residential structure depending on the particularly application and the wishes of an individual desiring to use such a system.

Figure 3:
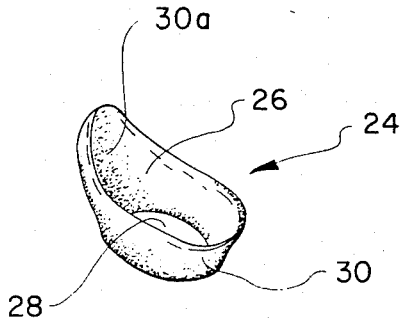
FIG. 3 is a perspective view of a vaginal insert designed to be utilized in conjunction with the urine receiver of the present invention in order that the same can be conveniently and effectively used by a female.

With respect to FIG. 3, there is shown a vaginal insert 24 that is designed to be inserted into the top opening 16*a* of urine receiver 16. Viewing vaginal insert 24, it is seen that the same includes an open top 26, an open bottom 28, and a surrounding wall structure 30 that can be molded from plastic or made from any other suitable type of material. It is seen that vaginal insert 24 is generally ovular or elongated so as to appropriately fit the area of intended use. In this regard, it is noted that surrounding wall structure 30 includes an elevated and slightly flared lip area 30*a* that is designed to cup around a particular portion of the female's upper vaginal area.

In use vaginal insert 24 is inserted in opening 16*a* and urine receiver 16 is positioned appropriately such that urine is directed down through urinal insert 24 into and through urine receiver 16 and on through flexible line 18 to a particular drain line for final disposal. It is contemplated that when used in a family environment that each female member of the family will have her own vaginal insert 24.

From the foregoing specification, it is appreciated that the present invention presents a portable dry handheld urinal disposal system that is designed to be utilized by both male and female. Of particular importance is that the system of the present invention is relatively simple, inexpensive, easy to install and use, and adapted such that the same can be installed at various places within a residential dwelling and can be communicatively connected to any type of drain line or septic line forming a part of the plumbing network of the residential structure.

In addition by using such the same can be periodically flushed and/or disinfected as desired.

Figure 4:
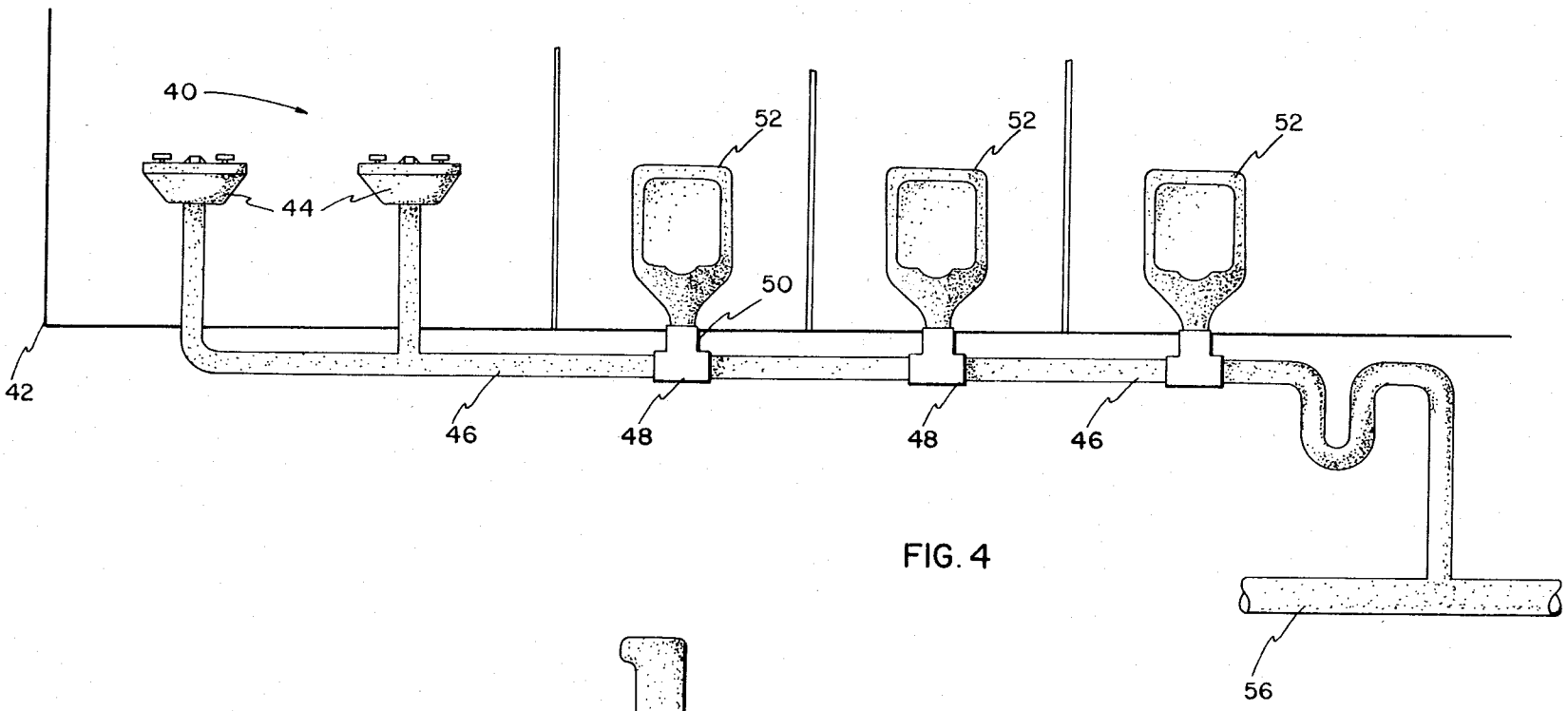
FIG. 4 is a diagrammatic illustration of a urine disposal system that is designed to be utilized within a public restroom facility.
Figure 5:
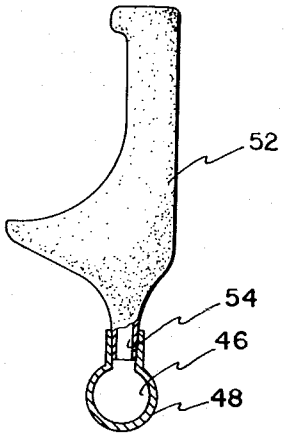
FIG. 5 is a side elevational view showing the mounting of a removable lightweight portable urinal on a restroom facility drain line.

With reference to FIGS. 4 and 5, there is shown therein a urine disposal system for a public restroom facility. As illustrated, the urine disposal system is indicated generally by the numeral 40 and is housed at least in part within a restroom facility 42.

Viewing FIGS. 4 and 5 in detail, it is seen that there is provided a conventional drain line 46 that extends through or adjacent the restroom facility 42. Drain line 46 is operatively connected to one or more sinks or lavatories 44. It is appreciated that waste water therefrom is directed from the sink or lavatory 44 into drain line 46 which ultimately channels the waste water or waste material to a main sewer line 56 that passes in close proximity to restroom facility 42.

Provided along drain line 46 intermediately between lavatories 44 and main sewer line 56 is a series of urinal adapters that enable portable lightweight urinals to be connected and supported on said drain line 46. Urinal adapters are disclosed herein and as shown in the drawings include a collar portion 48 that fits co-axially around drain line 46. In addition each urinal adapter includes an upstanding receiver 50 that is provided with an opening therein that is communicatively connected or open to drain line 46.

Each urinal adapter is designed to operatively connect and receive a lightweight urinal 52. In the present disclosure, it is contemplated that the portable urinal 52 would be constructed of plastic or some other suitable material. Each portable urinal 52 includes an integrally formed down spout 54 that is adapted to communicatively connect with the receiver portion 50 of the urinal adapter. In the case of the particular disclosure shown herein, it is contemplated that there would be provided a frictional fit between the down spout 54 and receiver 50. This would enable the respective urinals to be easily removed and cleaned.

From the foregoing it is apparent that the urine disposal system disclosed in FIGS. 4 and 5 present a relatively inexpensive approach to providing urinal facilities for a large number of people with a minimum of cost. It is appreciated that the presence of the sinks or lavatories 44 will serve the flushing or cleaning action of the drain line 46. In addition, the urinals 52 can be easily removed and cleaned. This system obviates the necessity of providing plumbing to each of the respective urinals and this in itself will lead to a substantial saving in cost.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A relatively inexpensive dry urinal disposal system for use in conjunction with a public rest room facility comprising in combination:

A. a public rest room facility;

B. lavatory means disposed in said public rest room facility and including a basin for receiving water;

C. a drain line having a vertical section that extends downwardly from said basin of said lavatory means;

D. said drain line further including a horizontal drain line section that extends from said vertical drain line section generally horizontally adjacent said rest room facility for channeling and directing waste water from said basin of said lavatory means;

E. main sewer disposal line means connected to said generally horizontal drain line section for channeling waste water and other material passing through said drain line from said drain line and away from said public rest room facility;

F. a plurality of laterally spaced urinal adapters connected to said generally horizontally disposed drain line section extending adjacent said rest room facility;

G. each of said plurality of urinal adapters including a receiver secured around said horizontal drain line section and having an upstanding open pipe projecting upwardly from said horizontal drain line section with said upstanding open pipe including an opening therein;

H. a plurality of urinals secured to and supported by respective receivers connected and spaced along said horizontal drain line section;

I. each of said plurality of urinals including quick attach and detach means for detachably securing said respective urinal to said receivers for enabling the respective urinal to be quickly and easily attached to and detached from said generally horizontal drain line section; and J. said quick attach and detach means including a down spout extending from each respective urinal and communicatively connected therewith with said down spout having a selected outside diameter such that said down spout will frictionally fit within the opening of said upstanding pipes of said receivers.

* * * * *